US006109612A

United States Patent [19]

Moore

[11] Patent Number: 6,109,612

[45] Date of Patent: Aug. 29, 2000

[54] METHOD OF PLAYING A RANDOM-DEAL POKER GAME

[76] Inventor: James Chyvan Moore, P.O. Box 2054, Palm Springs, Calif. 92263

[21] Appl. No.: 09/361,635

[22] Filed: Jul. 26, 1999

Related U.S. Application Data

[60] Provisional application No. 60/092,455, Jul. 29, 1998.

[51] Int. Cl.[7] ..... A63F 1/00

[52] U.S. Cl. ..... 273/292; 273/274

[58] Field of Search ..... 273/292, 274, 273/309, FOR 292, FOR 274, FOR 309

[56] References Cited

U.S. PATENT DOCUMENTS 5,597,162 1/1997 Franklin .
5,979,897 11/1999 Grossman .

*Primary Examiner*—Jeanette Chapman
*Assistant Examiner*—Vishu Mendiratta

[57] ABSTRACT

This poker game is based on the speed with which a player makes a pre- determined poker hand by using randomly distributed cards from the top of the deck. The first player to complete that hand is declared the winner of the pot.

The game is played in the high traffic casino pit areas to attract new and casual players to a game they could enjoy.

A one bet only system is used to make a more congenial, less intimidating game.

The game features a progressive jackpot for any player's highly unusual winning streak.

The game is played on a Blackjack-type table with a special felt layout.

3 Claims, 1 Drawing Sheet

METHOD OF PLAYING A RANDOM-DEAL POKER GAME

This application claims benefit to U.S. provisional Ser. No. 60/094,455 filed Jul. 29, 1998.

BACKGROUND OF THE INVENTION

This invention relates to the casino game of Poker.

Thousands of gamblers play Poker daily in public poker rooms. Thousands of other gamblers aspire to become Poker players but lack the knowledge and confidence they would like to have.

This is due largely to the fact a poker game can become confusing, unfriendly and costly, particularly to novice gamblers.

The action can be sometimes slow and dull in relation to Blackjack, Slots, Roulette and Craps as played on the main casino floor.

While most regular casino pit games can be played to a win or lose decision for a single bet, Poker can extract several bets from a given player in a single hand.

A novice player is usually at a huge disadvantage when engaged in a poker game with veteran players.

Casual gamblers may aspire to play Poker for years but never summon up the courage to engage in a single game.

Most casual gamblers do not have a large amount of time to spend in a casino. When they do, they like as much action, fun and excitement as possible in their limited amount of playing time.

A good Poker player doesn't stay in for every hand, and therefore action is often slow, dull and unappealing to the average gambler.

Therefore, most casino gamblers stay with what's comfortable for them in the gambling arena, be it Slots, Blackjack or whatever seems the most simple to them as long as it amuses them. Fast, simple and exciting is their main concerns when seeking an outlet for their gaming desires.

BRIEF SUMMARY OF THE INVENTION

This poker game establishes a new concept for Poker games. The winner in a regular poker game is the player who can form the best possible Poker hand after each player has received a given number of cards.

Usually there are from two to five betting intervals for each hand and all players must call every bet made in order to eventually win the hand and the pot.

This poker game awards the pot to the player who makes a given hand before others make that given hand, using cards which come off the deck in random order.

Each strives to make a three card and then a six card straight flush in their designated suit of Spades, Hearts, Diamonds or Clubs. With a player for the six lower cards and a player for the six higher cards, as many as eight players can play each hand.

Since each player bets a pre-determined amount to play each hand to the end, all players have an equal chance to win at the start of every hand.

This should be the only Poker game available where a novice can play on equal terms with a veteran and still enjoy the fun, excitement and fast-paced game that most gamblers seek.

All players also have a chance to win progressive jackpots by winning both the pot for the three card straight flush and the pot for the six card straight flush. By winning three or more times in a row, any player can win the jackpots.

The ultimate goal of this game is to create a friendly game where a novice gambler has the same chance to win as any other player. A game where they may play with complete confidence and be intently involved in every hand from the first card dealt to the last dollar awarded to the winner.

A game simple enough for anyone to play, exciting enough for everyone to have great fun, and ongoing action with the turn of every card.

This poker game offers every player in the casino a diversion from the standard games.

The game is played on a special game felt designed to fit on a Blackjack-type table.

BRIEF DESCRIPTION OF THE DRAWING

The playing surface is a felt surface designed to fit on a Blackjack-type table.

There are eight playing areas to accommodate up to eight players.

Figure 1:
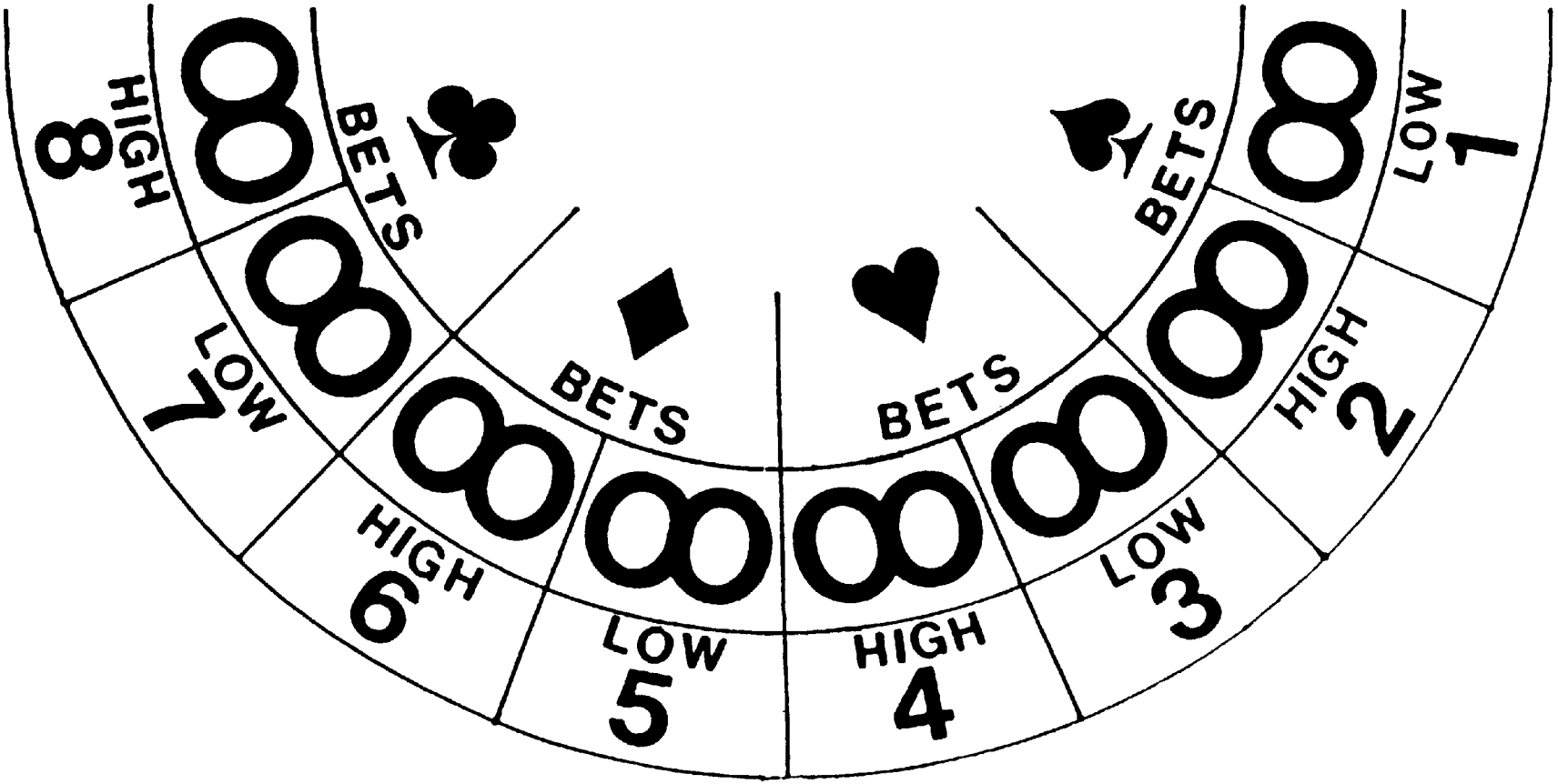

There are two betting circles for each player. One basic bet will be wagered on winning the first part of the hand (three cards), and two basic bets will be wagered on winning the second part of the hand (six cards). The one bet will be placed in the right circle and two bets will be placed in the left circle.

The dealer will turn the top card of the deck and pass that card to the corresponding suit area as marked. Each player will take his proper cards and proceed to form his winning hand as quickly as possible.

The low side and high side hand areas are marked for each player of one through eight, with a high and low area marked for each suit.

DETAILED DESCRIPTION OF THE INVENTION

1. This poker game may be played with any number of players from two to eight. The players will play against each other but not against the House. The game is played with a standard deck of 52 playing cards.

2. The object of the game is to make a three card straight flush and a six card straight flush before any other players do so. The winning player in each category will win the designated poker pot for each hand.

3. The playing table will accommodate eight players, with seat number one to the left of the dealer and proceeding clockwise to seat number eight on the right side of the dealer. The space between seat number one and two will have a spade emblem imprinted on the layout. There will be a heart emblem imprinted between seat three and four, with a diamond emblem between five and six, and a club emblem between seven and eight. There will be two betting circles on each side of each of the four emblems.

4. The seat a player sits in will determine the suit of the straight flushes each player must make to win a pot. Seats one and two will try for spades, seats three and four for hearts, five and six for diamonds, and seven and eight for clubs.

Seats one, three, five and seven will try for the low side of their straight flushes, while seats two, four, six and eight will try for the high side straight flushes.

Each player may choose the seat desired on a first come, first served basis. However, the first four players must choose a seat in four different suits. Any time one side of a suit is unoccupied, the player on the other side may play both sides if they choose.

Players may change seats when one comes open if they do not leave a suit totally vacant. If a suit becomes totally vacant, another player must move into that suit as long as there are at least four players. If no player volunteers then they will draw cards, but that player must come from a suit that is double occupied.

5. At the start of each hand, each player will place a basic bet in one of his betting circles and two basic bets in the other circle. The basic bet will be pre-determined at each table. These bets will create two separate pots for the winning players.

The smaller pot will be awarded to the first player to make their three card straight flush and the larger pot will be awarded to the first player to make their six card straight flush. All players are eligible to win both pots!

6. When a player plays the low side of their suit, they must make a three card straight flush with the A-2-3 or 4-5-6, and a six card straight flush with the A-2-3-4-5-6.

The high side player must make their straight flushes with the K-Q-J or 10-9-8 for their three card hand, and then the K-Q-J-10-9-8 for their six card straight flush.

The first player to succeed with the three card hand collects the small pot, and the first player to succeed with the six card hand collects the large pot.

All players are eligible to win both pots!

7. The dealer starts each hand by turning the top card of the deck and passing that card to the appropriate playing area. Spades are passed to the spade area, hearts to the heart area, etc. Dealer will continue turning one card at a time and passing it to the proper area.

It then becomes the responsibility of each player to assemble their cards face up until they create their three card straight flush. Player announces his winner to the dealer and collects the small pot when the dealer verifies the win. The deal then continues until the six card straight flush wins.

When the large pot is won the hand is over and the dealer proceeds to the next hand.

All standard House rules shall apply to the shuffle and deal. However, because of the nature of the game, stringent precautions should be taken to mix the cards well on every deal!

8. When a player wins both pots, he becomes eligible to win bonus payouts from the jackpot pool based on the number of spots being played and the number of consecutive wins for both pots. Consecutive wins must be by the same player on the same spot!

A. With six or more spots played:

3 consecutive wins———10% of jackpot pool 4 consecutive wins———40% of jackpot pool 5 consecutive wins———80% of jackpot pool B. With four or five spots played the bonus awards will be 25% of the above awards.

9. It is suggested the House seed the original jackpot pool with $1,000.00.

It is permissible to play a spot on an adjacent, unoccupied suit. However, every player will be limited to two spots. If there are four players or more, then each player will be limited to playing in one suit.

10. The basic bet limit will determine the size of the rake. If less than four spots are played there would be no rake. With four or more spots played, the House would rake one basic bet from the larger pot. With a 1–2 limit, the House would rake one dollar. With a 2–4 limit, the rake from the larger pot would be two dollars. With a 3–6 limit, the rake would be three dollars and always from the larger pot.

This would constitute an 8.33% rake with four spots played, 6.67% with five spots, 5.55% with six spots, 4.76% with seven spots, and 4.17% with eight spots played. Three dollars should be the maximum rake or possibly four dollars only if the basic bet is 6–12 limit or more.

This would create a maximum rake of 5.55% and a minimum of 2.77% at the six dollar minimum bet, and much less at a four dollar maximum rake in larger games.

11. Twenty-five percent of the daily rake would be placed in the jackpot pool to produce a progressively higher jackpot.

12. All standard House rules and dealing procedures will apply.

13. The casino may vary the size of their rake and jackpots at their discretion.

What is claimed is:

1. A method of playing a random-deal poker game in a casino between a plurality of players comprising the steps of:

providing one conventional deck of 52 playing cards, each card having a numerical or rank value in four standard suits of spades, hearts, diamonds and clubs;

providing a playing board having a dealer area and having a plurality of designated areas, assigning the dealer area to the dealer, and assigning one or two designated areas to each player of the plurality of players;

the dealer initially turning the top card of the deck and passing that card to the corresponding suit area as marked for each of the plurality of players;

further, the dealer continues to turn each top card in succession, passing that card to the corresponding suit area of each player;

each player takes their proper cards and proceeds to form a winning hand as quickly as possible;

by assembling their random cards in their designated area to complete a run of three ranks in the numerical order and suits as predetermined for each of the players by their own designated area, as marked;

with each player required to complete their three card hand first in order to become the first winner of that hand;

each player then required to complete a six card hand as designated by each of their assigned playing areas and using the same procedure as required for the winning three card hand;

with the first player forming the six card hand, as required, becoming the second and final winner in that hand of play between the plurality of players.

2. The method of playing a poker game, according to claim 1, further comprising the steps of:

each player of the plurality of players placing a one unit bet and a two unit bet of predetermined size in their designated betting circles on the playing board;

the one unit bet forming a players' pool to be awarded to the first winner of each hand;

the two unit bet forming a players' pool to be awarded to the second and final winner of each hand;

with each player being eligible to win a jackpot by successfully winning both pools in the same hand, for a given number of times in succession as determined by the casino;

the size of the jackpot being determined by the casino.

3. The method of playing a poker game according to claim 2:

further permitting any player, of the plurality of players, that so desires to play two hands by placing the required additional bets in any betting area unoccupied by any other player, thereby becoming eligible to win any player pool with a winning hand in either designated area.

* * * * *